US005758460A

United States Patent [19]

MacKarvich

[11] Patent Number: 5,758,460

[45] Date of Patent: Jun. 2, 1998

[54] PIER PLATFORM AND CLEAT ASSEMBLY FOR MANUFACTURED HOME

[76] Inventor: Charles J. MacKarvich, 1720 Tyler Green Trail, Atlanta, Ga. 30080

[21] Appl. No.: 787,876

[22] Filed: Jan. 23, 1997

Related U.S. Application Data

[63] Continuation-in-part of Ser. No. 644,069, May 9, 1996, Ser. No. 629,834, Apr. 10, 1996, and Ser. No. 739,717, Oct. 29, 1996.

[51] Int. Cl.[6] ..... E02D 27/00

[52] U.S. Cl. ..... 52/292; 52/295; 52/146; 52/156

[58] Field of Search ..... 52/169.9, DIG. 11, 52/23, 148, 146, 299, 155, 156, 157, 292, 295

[56] References Cited

U.S. PATENT DOCUMENTS 3,750,349 8/1973 Deike ..... 52/23

*Primary Examiner*—Creighton Smith

*Attorney, Agent, or Firm*—Thomas, Kayden, Horstemeyer & Risley

[57] ABSTRACT

A pier platform and cleat assembly (28) for supporting a pier (14) upon which a manufactured home (12) is supported. A substantially planar platform (30) is placed upon the ground surface and the pier is supported upon the platform. One or more cleats (40) hold the platform against the ground surface and prevent the platform from shifting in position. The cleats can be attached by U-bolts (50) to the platform after the platform is placed into position and the cleats are detachable from the platform.

10 Claims, 3 Drawing Sheets

PIER PLATFORM AND CLEAT ASSEMBLY FOR MANUFACTURED HOME

CROSS REFERENCE

This is a continuation-in-part of U.S. patent applications Ser. No. 08/644,069, filed May 9, 1996, 08/629,834, filed Apr. 10, 1996, and Ser. No. 08/739,717 filed Oct. 29, 1996.

FIELD OF THE INVENTION

The invention relates generally to a foundation system for a manufactured home which is supported above the ground on a plurality of piers. More particularly, the invention relates to a supporting or stabilizing platform and cleat assembly upon which each pier is supported. The apparatus can be used with a variety of foundation systems.

BACKGROUND OF THE INVENTION

Manufactured homes, such as mobile homes, trailers, prefabricated houses, and the like are manufactured at a central manufacturing site, and upon completion the homes are moved to a location where they are to be permanently located and occupied. Because the home is designed to be easily moved from the manufacturing site to the permanent location, it is not originally built upon a permanent foundation at the manufacturing site, but rather is constructed upon a pair of parallel I-beam joists. The manufactured home is then transported to the installation site where the home will be occupied, and mounted upon piers, such as concrete blocks, pilings, or stabilizing jacks. It is important that the home be anchored in position on the piers, typically with the use of soil anchors and ties extended from the anchors to the framework of the home, so as to avoid the home being shifted off of its piers by strong winds or earth tremors. Serious damage to the home and even human injury can occur if a home is inadvertently shifted off of its piers.

Various types of stabilizing devices have been used to stabilize such homes, to keep the homes from moving in response to wind forces and earth movement. Such devices have included guy-wires or straps tying the home to ground fixtures or anchors either permanently or temporarily inserted in the ground. A traditional approach to providing wind storm protection for manufactured homes consists of an anchor having a shaft with one or more helical plates at the bottom of the shaft which can be rotated to move into the earth, and cold rolled steel strapping installed as a diagonal tie between the anchor head and the lower mainframe of the manufactured home. A system of this type is taught in U.S. Pat. No. 3,747,288. In addition, vertical or "over the top" ties may be installed in the case of single wide structures.

The vertical support for the manufactured home usually is provided by the piers located under the parallel joists of the mainframe of the manufactured home, with the vertical supports being spaced longitudinally along the parallel joists at approximately 8 feet from one another. These piers are typically placed upon a flat planar stabilizer plate having a much larger surface area than the pier itself which stabilizes the pier at its interaction with the ground surface. For example, see U.S. Pat. No. 3,751,866 to Renchen and U.S. Pat. No. 3,830,024 to Warnke, both of which teach foundation systems for manufactured homes which utilize pier platforms.

Pending applications of the Applicant, U.S. Ser. No. 08/644/,069, filed May 9, 1996, U.S. Ser. No. 08/629/834, filed Apr. 10, 1996, and U.S. Ser. No. 08/739,717, filed Oct. 29, 1996, teach various embodiments of manufactured home foundation stabilizing systems which utilize pier platforms having cleats that extend into the ground and provide additional reassurance against lateral movement of the piers and the foundation system as a whole.

In particular, U.S. Ser. No. 08/629,834 teaches a stabilizing foundation system including piers arranged in opposed pairs, a cleated stabilizer plate or pier platform placed beneath each pier, a soil anchor inserted into the ground at the outside of an aligned with each pier, and a tension strap connecting each anchor to the lower frame of the manufactured home. The system further includes an outer stabilizer bar positioned flat on the ground extending between and abutting each anchor and its associated pier. The bar is attached at its end next to the pier to the cleated pier platform. The system can further include an intermediate stabilizer bar extending between and abutting each pier of a pair of piers and attached to the stabilizer plates under the piers at its ends. A cleated stabilizer plate taught in U.S. Ser. No. 08/629,834 includes an upwardly facing planar surface which receives the pier, and cleats extending downwardly from the platform and arranged to penetrate the ground surface. The cleated plate taught therein is a unitary plate, meaning the planar surface and the extending cleats are one piece. Other embodiments of cleated plates are also taught in this application, all being made of a unitary piece of sheet metal.

A disadvantage of the unitary cleated plates is that each plate is provided having cleats of a particular size. In order to provide various sized cleats that penetrate the ground to a greater or lesser extent, different plates would have to be provided, each having different sized cleats. Different size cleats are preferred because in areas of looser soil such as sand, cleats that penetrate the ground to a greater extent are desirable, whereas in areas of denser soil, smaller cleats which penetrate the ground to a lesser extent are adequate. Also, once the unitary cleated plates are installed in the ground and a pier is mounted on top of the plate, there is no way to change the cleat size of the cleated plate without removing the entire cleated plate and its pier assembly.

SUMMARY OF THE INVENTION

Thus, it is an object of the present invention to provide an improved pier platform and cleat assembly for use in a stabilizing foundation system of a manufactured home which stabilizes the home against wind forces and earth movements.

Another object of the present invention is to provide an improved pier platform and cleat assembly for use in a stabilizing foundation system of a manufactured home which can be provided with various sized cleats.

A further object of the present invention is to provide an improved pier platform and cleat assembly wherein the cleat size can be readily changed even after the platform is installed under a pier.

Other objects, features, and advantages of the present invention will become apparent upon reading the following specification, when taken in conjunction with the accompanying drawings.

DETAILED DESCRIPTION OF THE PREFERRED EMBODIMENT

Figure 1:
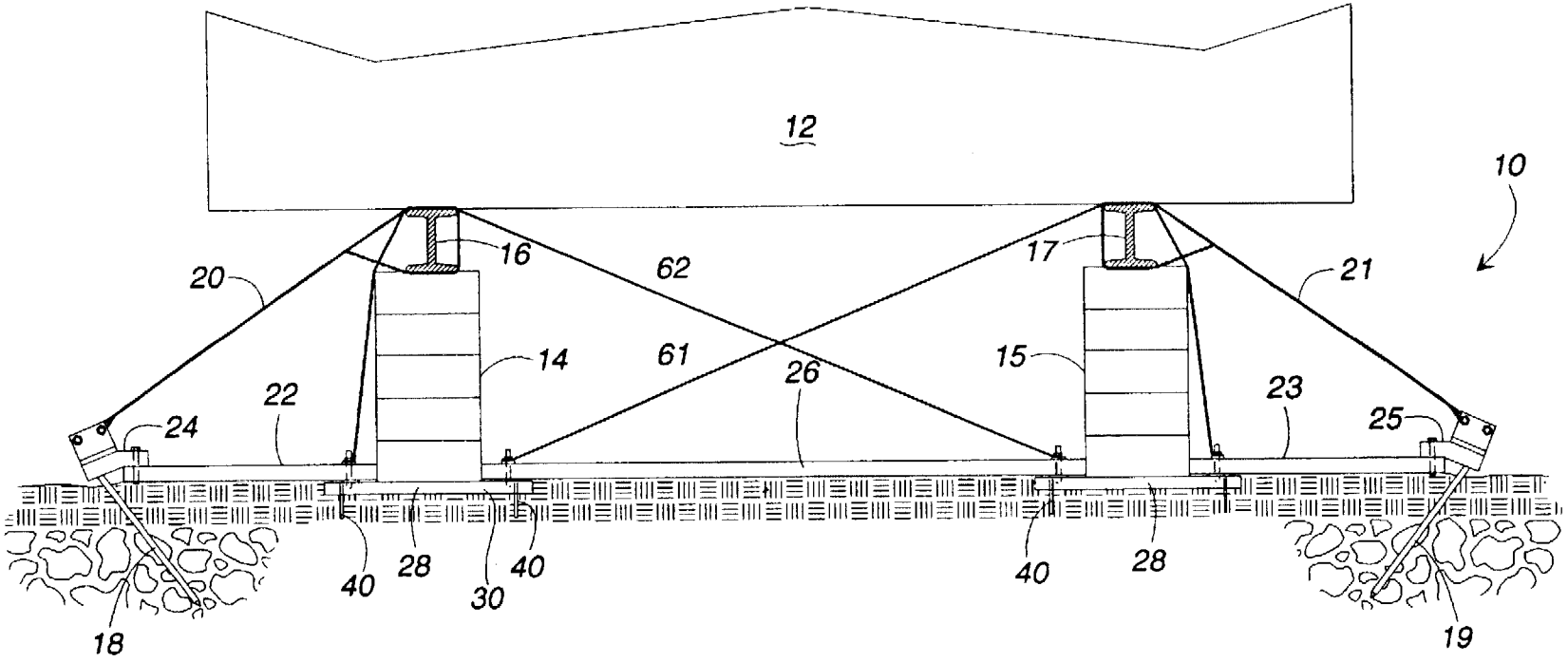
FIG. 1 is a side elevational view of a manufactured home stabilizing foundation system utilizing the pier platform and cleat assembly of the present invention.

Referring now in more detail to the drawings, in which like numerals refer to like parts throughout the several views, FIG. 1 illustrates a stabilizing foundation system 10 for a manufactured home 12. Many components of the foundation system 10 are similar to those disclosed in pending applications of the Applicant, U.S. Ser. No. 08/644,069, filed May 9, 1996, U.S. Ser. No. 08/629,834, filed Apr. 10, 1996, and U.S. Ser. No. 08/739,717, filed Oct. 29, 1996, the disclosures of which are hereby incorporated by reference. The manufactured home 12 typically is supported upon a plurality of piers 14, 15 by one or more parallel I-beams 16, 17 that are attached lengthwise to the undercarriage of home 12. The I-beams function as the lower frame of the home. Manufactured home 12 includes cross braces or joists on the underside thereof (not shown), upon which I-beams 16, 17 are supported. As a result, there are spaces between the underside of home 12 and I-beams 16, 17.

A plurality of soil anchors 18, 19 are inserted into the ground, typically with an anchor adjacent the outside of each pier 14, 15. Thus, a pair of anchors 18, 19 and a pair of piers 14, 15 are aligned across the manufactured home 12. A strap 20, 21 is attached between each soil anchor 18, 19 and the adjacent I-beam 16, 17 at a location on the I-beam adjacent where I-beam 16, 17 contacts pier 14, 15. Straps 20, 21 may be a flat metal strap or other fastening tie. Strap 20, 21 may be fastened to the home in a number of ways and are here shown with one of an end wrapped around I-beam 16, 17 and secured with a buckle that attaches the end of the strap to the body of the strap.

Piers 14, 15 may be stacked concrete blocks, solid concrete piers, or made out of steel, bricks, wood, or any other supportive material. In the embodiment shown in FIGS. 1 and 2, piers 14, 15 are stacked concrete blocks.

Figure 2:
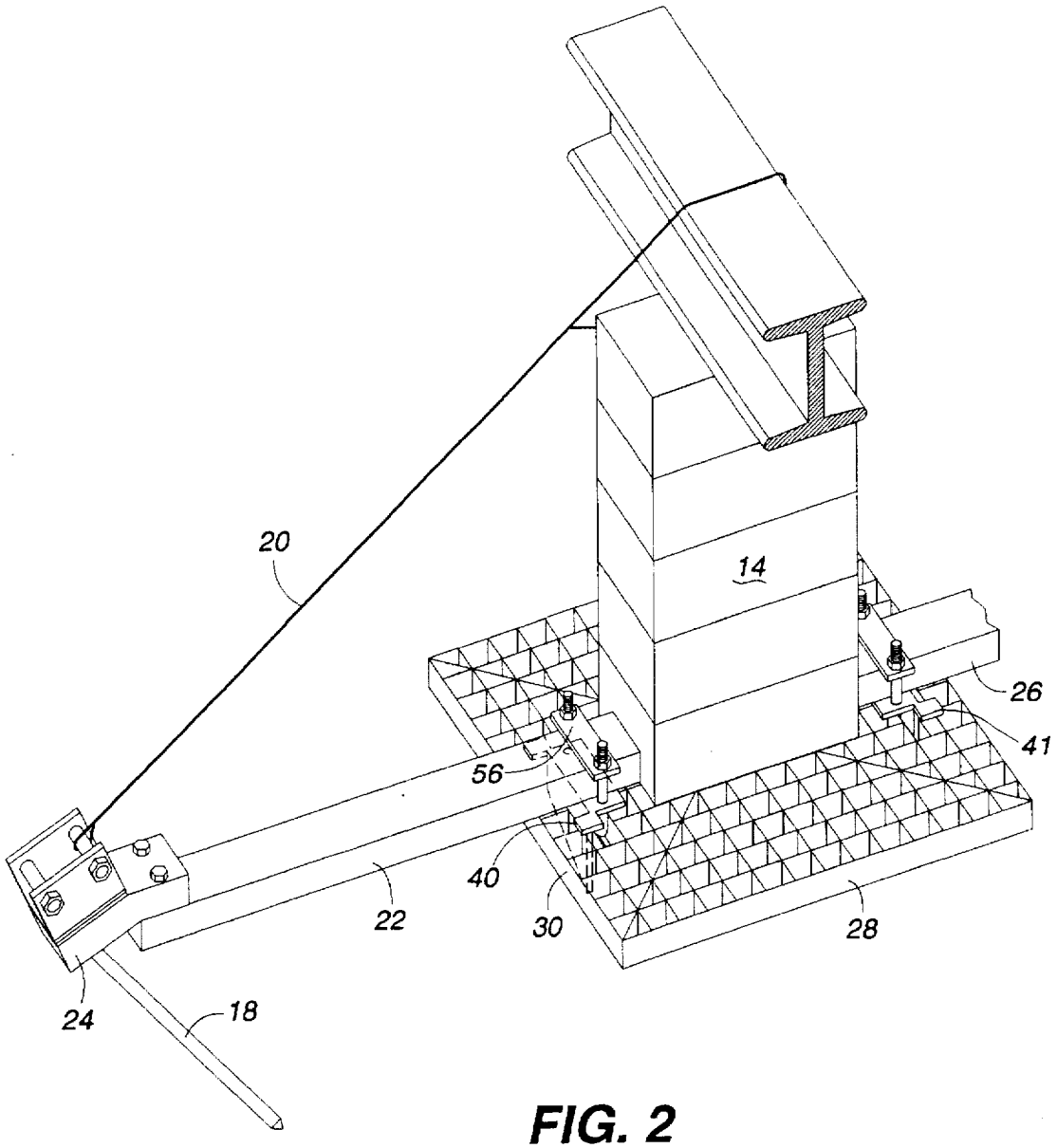
FIG. 2 is a perspective view of the pier platform and cleat assembly of the present invention shown with components of a manufactured home stabilizing foundation system.

The foundation stabilizing system 10 shown in FIGS. 1 and 2 is further stabilized by outer lateral stabilizer bars 22, 23 placed on the ground surface between each anchor 18, 19 and its adjacent pier 14, 15, respectively. Preferably, the bars 22, 23 closely abut the pier 14, 15 and are held tightly in place to the anchor 18, 19 by a bracket 24, 25. In the embodiment shown in FIGS. 1 and 2, an intermediate stabilizer bar 26 further adds stability and is placed on the ground between adjacent piers 14, 15, with one end closely abutting each of the piers 14, 15. The above described components of a foundation stabilizing system are generally described in Applicant's pending patent applications.

A pier platform and cleat assembly 28 of the present invention is placed under each pier 14, 15. As shown more clearly in FIGS. 2 and 3 pier platform and cleat assembly 28 includes a square shaped pier platform 30 having a planar surface next to the ground surface and, on the top side, or side next to the pier, a pattern of recessed portions or cells 36 formed by walls 32 and 34. In other words, the pier platform 30 includes a floor portion (not shown) having a plurality of upstanding lateral and longitudinal perpendicular walls 32 and 34, respectively, defining recessed portions or cells 36. Pier platform 30 can, of course, have any of a number of different shapes and configurations. Pier platform 30 preferably has a larger surface area than the bottom surface of a pier 14, 15, thereby spreading the weight of the pier and the manufactured home over a larger ground surface area.

Pier platform 30 can be made out of plastic, concrete, metal, or any sturdy composite material. Two elongated slits or apertures 38, 39 are formed in the floor of the pier platform, parallel with lateral walls 32. Portions of the longitudinal walls 34 are cut out in the vicinity of the slits 38, 39, as further described below.

Figure 3:
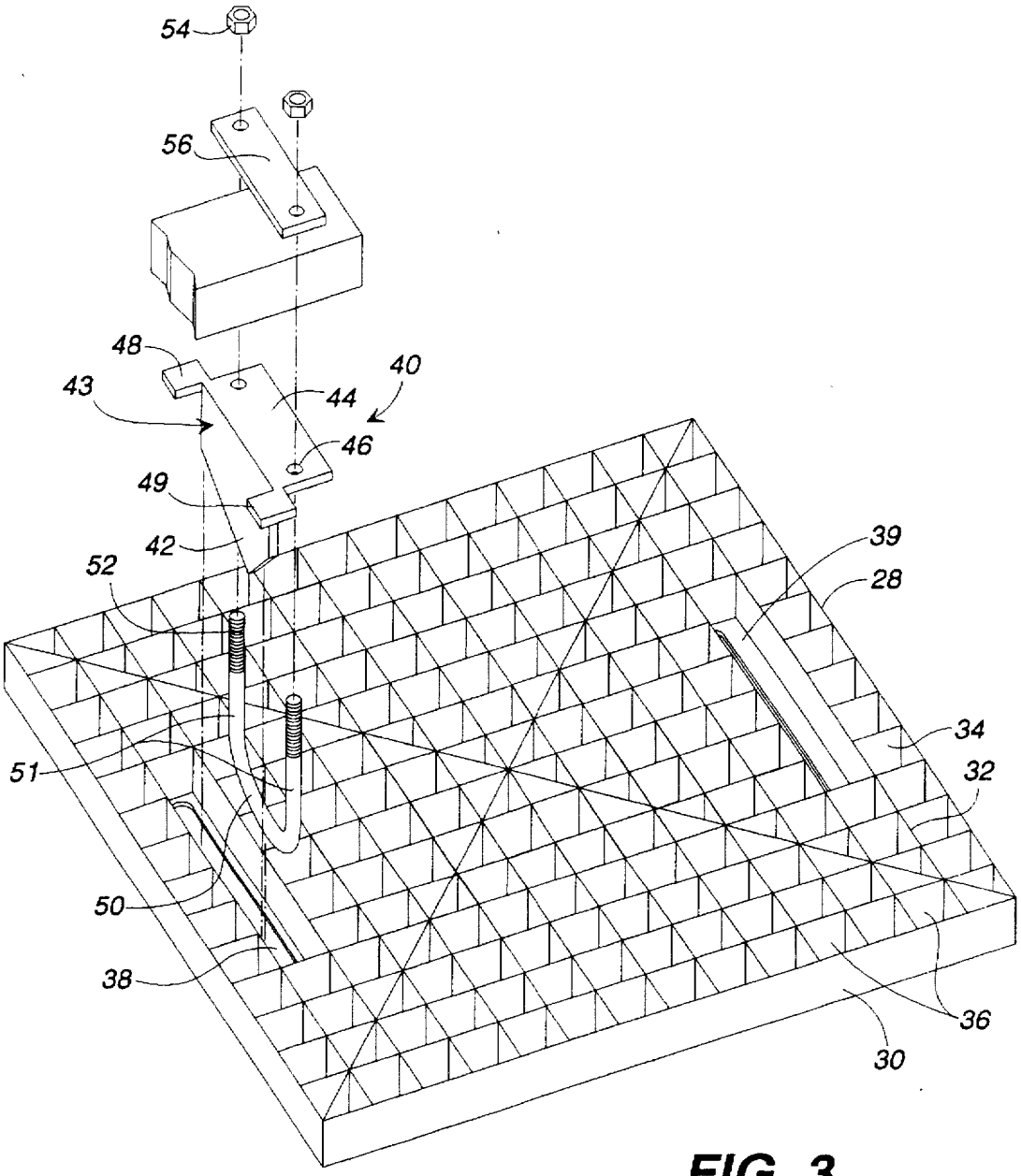
FIG. 3 is a perspective exploded view of the pier platform and cleat assembly of the present invention.

A cleat 40, shown most clearly in FIG. 3, includes a substantially planar ground engagement or triangular portion 42 extending from a rectangular portion 43 that is sized and shaped to extend through a slit 38, 39. A platform engagement or main tab portion 44 extends perpendicularly from the rectangular portion 43 and includes a pair of opposed apertures 46. A pair of side tabs 48, 49 extend from the rectangular portion 43 and are folded away from but parallel with tab 44. A U-bolt 50 having threaded ends 52 can be inserted with one of its arms 51 extending through each of the opposed apertures 46. A nut 54 can be fastened onto each of the threaded ends 52 of U-bolt 50. This functions as a connector means and rigidly mounts the cleat 40 to the stabilizer bar 22, fixing the stabilizer bar with respect to the pier platform 30.

In use, as shown in FIG. 2, when a pier 14 is to be installed on a pier platform 30, a cleat 40, 41 is installed through each slit 38, 39, respectively, so that triangular portion 42 of each cleat passes through slit 38, 39 and is inserted into the ground. The cleat 40, 41 is pressed into the ground so that the tab 44 and side tabs 48, 49 abut against the pier platform 30. Because the longitudinal walls 34 are cut away around the slit, the tabs 44, 48, and 49 will abut the top of the platform. While the tab portions of the two cleats 40, 41 are shown oriented in particular directions, it does not matter in which direction these tabs are oriented.

U-bolt 50 is inserted upwardly through the opposed apertures 46 before the cleat is firmly inserted in place. As shown in FIG. 2, the outer stabilizer bar 22 and intermediate stabilizer bar 26 are placed with one end abutting the pier and so that the end lies between the arms of the U-bolt 50 of cleat 40 or 41, respectively. A fastening plate 56 having opposed apertures is placed with the apertures over the arms of the U-bolt and nuts 54 are then threaded onto threaded ends 52 of U-bolt 50 to hold the stabilizer bar securely against the cleat. If an intermediate stabilizer bar is used, it can be fastened to the pier platform and cleat assembly by similar means using the other cleat 41.

While there is described above one connector means for fastening the stabilizer bar to the pier platform and cleat assembly, it will be apparent that there are other connector means which fall within the scope of the invention such as bolts or straps. Further, in some cases it might not be necessary or desirous to employ stabilizer bars in the foundation stabilizer system and so connector means will be unnecessary for engaging the stabilizer bar.

While a cleat having a particular configuration is described above, it will be apparent that cleats having other configurations fall within the scope of the invention as long as they have a ground penetrating portion and a portion for engaging the pier platform.

An important aspect of the invention is that the size of the portion of the cleat that is to be inserted into the ground can be selected according to the type of soil upon which the foundation pad is placed. For example, for loose or low density soils such as those having a high concentration of sand, the triangular portion 42 of the cleat should be large. For areas where the soil has high density, the triangular portion can be smaller. This may be particularly useful when it is discovered that the soil is of a density different than thought when the foundation pad and pier were initially installed. In such a case, the entire pier platform and cleat assembly does not have to be replaced but, rather a cleat having a larger size triangular portion 42 can be installed.

While the pier platform and cleat assembly of the present invention is shown as employed in one type of foundation stabilizing system it can be appreciated that the invention can be utilized with a variety of embodiments of foundation stabilizing systems. For example, the inventive pier platform and cleat assembly can be used with the foundation stabilizing system embodiments shown in Applicant's previously filed patent applications. For example, rather than having an intermediate stabilizer bar 26, or, in addition to the intermediate stabilizer bar 26, the system can have cross ties 61 and 62 (FIG. 1) from one pier to the pier platform and cleat assembly of the opposed pier. In this case, a vector tension link (described in Applicant's pending applications) can be incorporated with the pier platform 30 and with the intermediate stabilizer bar 26. Also, in geographical areas where the expected wind velocity is lower than, for example, 80 miles per hour, the anchors and outer stabilizer bars may be unnecessary and only the cross ties 61 and 62 used with the pier platforms and cleat assembly.

While a preferred embodiment of the invention has been disclosed in detail in the foregoing description and drawings, it will be understood by those skilled in the art that variations and modifications thereof can be made without departing from the spirit and scope of the invention as set forth in the following claims.

What is claimed is:

1. A pier platform and cleat assembly, for supporting a pier of a manufactured home stabilizing system, which includes lateral stabilizer bars, said assembly comprising:

a substantially planar pier platform including at least one aperture;

a cleat detachably connected to one of the lateral stabilizer bars of the manufactured home stabilizing system, said cleat comprising a portion for inserting into the ground and a portion engaging said pier platform; and connector means rigidly connecting said cleat to the lateral stabilizer bar, whereby when the manufactured home stabilizing system is installed said cleat extends through said aperture of said platform and into the ground thereby securing said platform in place on the ground.

2. The pier platform and cleat assembly of claim 1, wherein said aperture of said platform is an elongated aperture and said cleat is substantially planar such that a width of said cleat extends along a length of said elongated aperture.

3. The pier platform and cleat assembly of claim 1, wherein said connector means comprises a U-bolt having arms with threaded ends and a bracket with opposed holes that are placed over said U-bolt arms and a pair of nuts for, that thread onto said threaded ends, wherein the stabilizer bar is placed between the aims of the U-bolt and is held in place with said bracket.

4. The pier platform and cleat assembly of claim 1, wherein said cleat portion for inserting into the ground is substantially planar and said cleat portion for engaging said pier platform is substantially planar and extends substantially perpendicularly from said portion for inserting into the ground.

5. The pier platform and cleat assembly of claim 4, wherein said portion engaging said pier platform comprises a main tab portion and at least one side tab portion.

6. The pier platform and cleat assembly of claim 1, wherein said portion for inserting into the ground is substantially planar and configured in the shape of a triangle.

7. A pier platform and cleat assembly, for supporting a pier of a manufactured home stabilizing system, that includes lateral stabilizer bars, said assembly comprising:

a substantially planar pier platform adapted to be placed between the pier and a ground surface, said pier platform comprising at least one elongated aperture;

a cleat detachably connected to one of the lateral stabilizer bars of the manufactured home stabilizing system, said cleat having a substantially planar ground insertion portion and a platform engagement portion; and connector means rigidly connecting said cleat to the lateral stabilizer bar, whereby when the manufactured home stabilizing system is installed, said Substantially planar ground insertion portion extends through said elongated aperture and into the ground and said platform engagement portion engages said pier platform such that said cleat prevents said pier platform from shifting in position.

8. A pier platform and cleat assembly, for supporting a pier of a manufactured home stabilizing system, that includes lateral stabilizer bars, said assembly comprising:

a substantially planar pier platform adapted to be placed between the pier and a ground surface;

a cleat detachably connected to one of the lateral stabilizer bars of the manufactured home stabilizing system, said cleat having a substantially planar ground insertion portion and a platform engagement portion; and connector means rigidly connecting said cleat to the lateral stabilizer bar, whereby when the manufactured home stabilizing system is installed, said substantially planar ground insertion portion extends into the ground and said platform engagement portion engages said pier platform such that said cleat prevents said pier platform from shifting in position.

9. The pier platform and cleat assembly of claim 8, wherein said substantially planar ground insertion Portion is triangular in shape and substantially perpendicular to said platform engagement portion, and said pier platform includes an elongated aperture through which said ground insertion portion is inserted.

10. The pier platform and cleat assembly of claim 9, further comprising two opposed elongated apertures in said pier platform and two cleats, said cleats being inserted through said apertures when the manufactured home stabilizing system is installed.

* * * * *